US005993328A

United States Patent [19]

Pedersen et al.

[11] Patent Number: 5,993,328

[45] **Date of Patent: *Nov. 30, 1999**

[54] GOLF CLUB SHAFT

[75] Inventors: Svein Pedersen, Askim, Norway; David S. Noyes, S. Boston, Mass.

[73] Assignee: True Temper Sports, Inc., Memphis, Tenn.

[ * ] Notice: This patent is subject to a terminal disclaimer.

[21] Appl. No.: 08/886,486

[22] Filed: Jul. 1, 1997

Related U.S. Application Data

[63] Continuation of application No. 08/603,270, Feb. 20, 1996, Pat. No. 5,685,781.

[51] Int. Cl.[6] ..... A63B 53/12

[52] U.S. Cl. ..... 473/318; 473/323

[58] Field of Search ..... 473/316, 317, 473/318, 319, 320, 321, 322, 323

[56] References Cited

U.S. PATENT DOCUMENTS

| | | | |
|---|---|---|---|
| 1,713,812 | 5/1929 | Barnhart . | |
| 2,040,540 | 5/1936 | Young . | |
| 2,086,275 | 7/1937 | Lemmon | 473/323 |
| 2,153,880 | 4/1939 | Barnhart . | |
| 2,220,852 | 11/1940 | Scott . | |
| 2,250,429 | 7/1941 | Vickery . | |
| 2,457,177 | 12/1948 | Reach . | |
| 3,170,690 | 2/1965 | Goranson et al. . | |
| 4,123,055 | 10/1978 | Brill . | |
| 4,856,782 | 8/1989 | Cannan . | |
| 5,251,896 | 10/1993 | Gerlach | 473/317 |
| 5,265,872 | 11/1993 | Tennent et al. . | |
| 5,316,299 | 5/1994 | Feche et al. . | |
| 5,496,028 | 3/1996 | Chien | 473/318 |
| 5,620,380 | 4/1997 | Tennent | 473/319 |
| 5,685,781 | 11/1997 | Pedersen | 473/318 |

FOREIGN PATENT DOCUMENTS

| | | |
|---|---|---|
| 9015387 | 12/1990 | France . |
| 9015388 | 12/1990 | France . |
| 465414 | 5/1937 | United Kingdom . |

OTHER PUBLICATIONS

Ozone™ Shaft, (circa 1996), Air Bear Woods.

Golfsmith Store, Apr. 1996, pp. 13 and 14, XPC Bulge graphite shaft.

*Primary Examiner*—Sebastiano Passaniti

*Attorney, Agent, or Firm*—Harness, Dickey & Pierce, P.L.C.

[57] ABSTRACT

A hollow golf club shaft including a plurality of diverging and converging substantially frustoconical sections. The sections have respective predetermined substantially constant wall thicknesses.

12 Claims, 3 Drawing Sheets

GOLF CLUB SHAFT

This is a continuation of application Ser. No. 08/603,270, filed on Feb. 20, 1996. U.S. Pat. No. 5,685,781

FIELD OF THE INVENTION

This invention relates generally to golf clubs and, more particularly, to an improved golf club shaft.

BACKGROUND ART

Young U.S. Pat. No. 2,040,540 discloses a metal shaft formed of sheet metal tubing which is tapered toward both ends, with the upper tapered section comprising the grip and covered by leather.

Lemmon U.S. Pat. No. 2,086,275 discloses both a wood shaft and a steel shaft, each of which includes three tapered sections, with one tapered section being the grip section, and the thickness of the walls of the tubular shafts causing a variation in the exact points of beginning and end of the three sections of the shaft, and the degree of the taper of the sections.

Barnhart U.S. Pat. No. 2,153,880 discloses a hollow metallic tube with no straight sections, and several of the sections having varying wall thicknesses.

Vickery U.S. Pat. No. 2,230,429 discloses a tubular metallic shaft having three cylindrical sections with adjacent sections joined at abruptly changing diameters.

Tennent et al U.S. Pat. No. 5,265,872 discloses a shaft formed of composite of polymers reinforced internally by fibers, and having a "modified hourglass" shape, with an intermediate cylindrical section being the base rod itself of from 6 to 12 inches in length.

Feche et al U.S. Pat. No. 5,316,299 discloses three shaft embodiments, each made of a composite material and each including a tapered grip section connected at the small diameter end thereof by a short connecting portion to a larger diameter upper end of (1) a downwardly diverging full shaft length section (first embodiment), (2) a cylindrical section (second embodiment), and (3) a downwardly converging section (third embodiment).

French publication nos. 2,670,120 and 2,670,121 disclose tapered shafts of composite material including bulging and contracting cylindrical sections. Publication 2,670,121 further discloses a bi-cone form.

Graman USA Inc. discloses a golf club including a graphite shaft with a, so-called, Triple Flexpoint System (TFS™) having sections with variable tapered outer surfaces and constant tapered inner surfaces.

Paragon Sports discloses a golf club including a graphite shaft with two kickpoints (DKS), as the result of three progressively decreasing cylindrical sections.

SUMMARY OF THE INVENTION

A general object of the invention is to provide a golf club having an improved golf club shaft.

Another object of the invention is to provide a golf club having an improved composite material golf club shaft.

A further object of the invention is to provide a golf club with a hollow shaft wherein the shaft is selectively contoured between the grip and hosel ends thereof, with variously contoured sections having respective substantially constant wall thicknesses.

Still another object of the invention is to provide a golf club having a shaft which is shaped to include a grip end and a hosel end, and three or more intermediate sections having respective small diameter and large diameter connector circles.

A still further object of the invention is to provide a golf club having, in seriatim, a contoured shaft with a grip end section of a predetermined shape, a first diverging substantially frustoconical section, a converging substantially frustoconical section, a second substantially diverging frustoconical section, and a hosel section of a predetermined shape.

Still another object of the invention is to provide such a contoured shaft, wherein the connector circles have respective predetermined diameters and are spaced at predetermined distances apart.

These and other object and advantages will become more apparent when reference is made to the following drawings and the accompanying description.

BEST MODE FOR CARRYING OUT THE INVENTION

Figure 1:
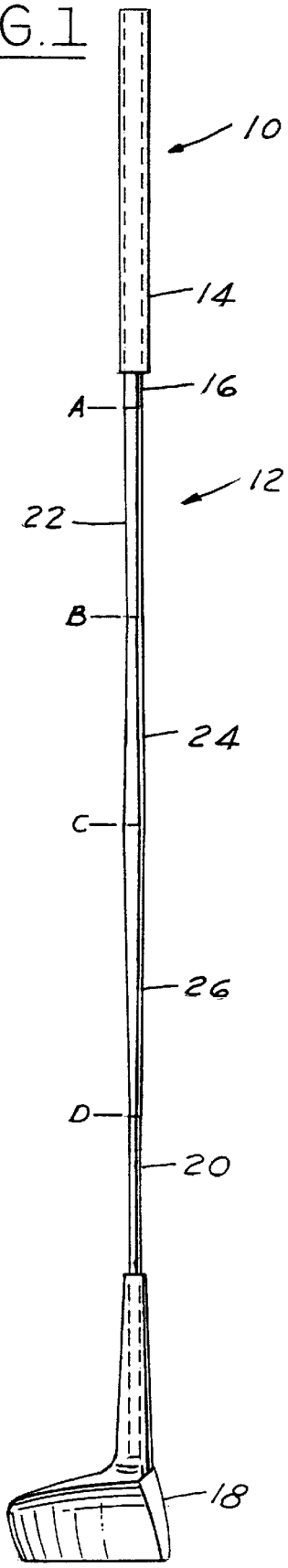
FIG. 1 is a side elevation view of a golf club embodying the invention.

Referring now to the drawings in greater detail, FIG. 1 illustrates a golf club 10 having a one-piece shaft 12 formed of a composite material, such as tubular material or sheets of carbon fibers and epoxy resin, or fiber glass and epoxy resin.

A grip 14 is formed and secured in any suitable manner around a grip end section 16 which is preferably cylindrical in shape, and a club head 18 is secured in any suitable manner to a bottom hosel section 20 which is preferably cylindrical in shape. A diverging substantially frustoconical section 22 extends from the grip end section 16 at a first circle A to a small diameter circle B. A converging substantially frustoconical section 24 extends from the section 22 at circle B to a large diameter circle C. A second diverging substantially frustoconical section 26 extends from the section 24 at circle C to a small diameter circle D at the beginning of the hosel section 20. The club head 18 is secured to the hosel section 20 to complete the golf club 10 structure.

Respective outer diameter ranges in mm are: at A 14 to 20; at B 11 to 16; at C 14 to 20; and at D 8 to 12.

Respective section lengths in mm are: for 16 170 to 500; for 22 100 to 300; for 24 100 to 300; for 26 180 to 480; and for 20 100 to 400.

A tabulation of suggested diameters at the various points along the shaft, and suggested lengths of the respective series of sections is as follows:

| Section | Shape | Length in mm | Outer Diameter in mm |
|---|---|---|---|
| 16 to A | cylindrical | 193 | at A: 14.86 |
| 22 to B | diverging | 200 | at B: 12.00 |
| 24 to C | converging | 200 | at C: 14.86 |
| 26 to D | diverging | 280 | at D: 8.61 |
| 20 from D | cylindrical | 270 | |

Each section 16, 20, 22, 24, and 26 has its own predetermined substantially constant wall thickness. A suggested wall thickness is in the range of 1 to 3 mm, wherein a preferred thickness is 1.1 mm for sections 16, 22, 24 and 26; and 1.5 mm for section 20. The section 24 wall thickness may, at times, average 1.1 mm, while varying from 1.3 mm at circle B to 0.9 mm at circle C.

While the above dimensions are preferred, each length, diameter and wall thickness may be specially varied to be better suited to golfers of different heights, reaches, strengths, swing tempos, and preferred ball flight trajectories. For example, if the length of section 16 is increased to 273 mm and the length of section 20 is shortened to 190 mm, in order to maintain the same overall length, the result is a shaft producing a lower launching angle providing a lower ball flight, less backspin, and greater roll on landing. Such a shaft may be preferable for a player who tends to hit the ball high. A similar result may be attained by increasing the length of sections 26 and/or 24, while decreasing the length of sections 16 and/or 20, while maintaining the same overall length, or by increasing the shaft diameters at circles B and D. The opposite effect of a "softer" feeling shaft and a resultant higher ball flight is produced by reducing the length of sections 24 and/or 26, while increasing the length of sections 16 and/or 20, and maintaining the same overall length. Also, the numbers of frustoconical sections may be varied. An additional reason to vary the dimensions and number of frustoconical sections may be to accommodate different golf clubhead and grip weights and specifications.

Figure 2:
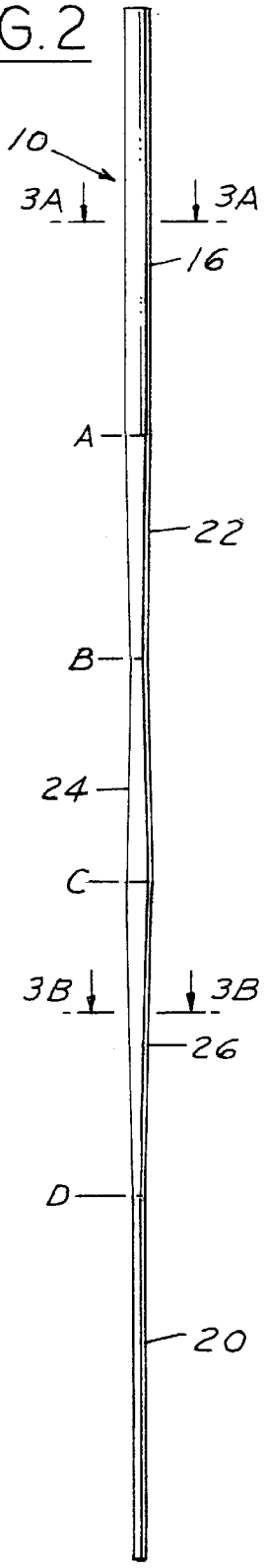
FIG. 2 is a side elevational view of the inventive golf club shaft.
Figure 3A:
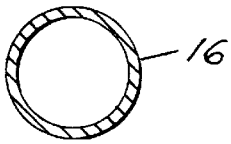
FIGS. 3A and 3B are cross-sectional views taken along the planes of the line 3A—3A and 3B—3B, respectively, of FIG. 2, and looking in the directions of the arrows.
Figure 3B:
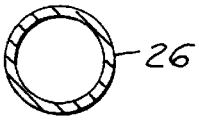
Figure 4:
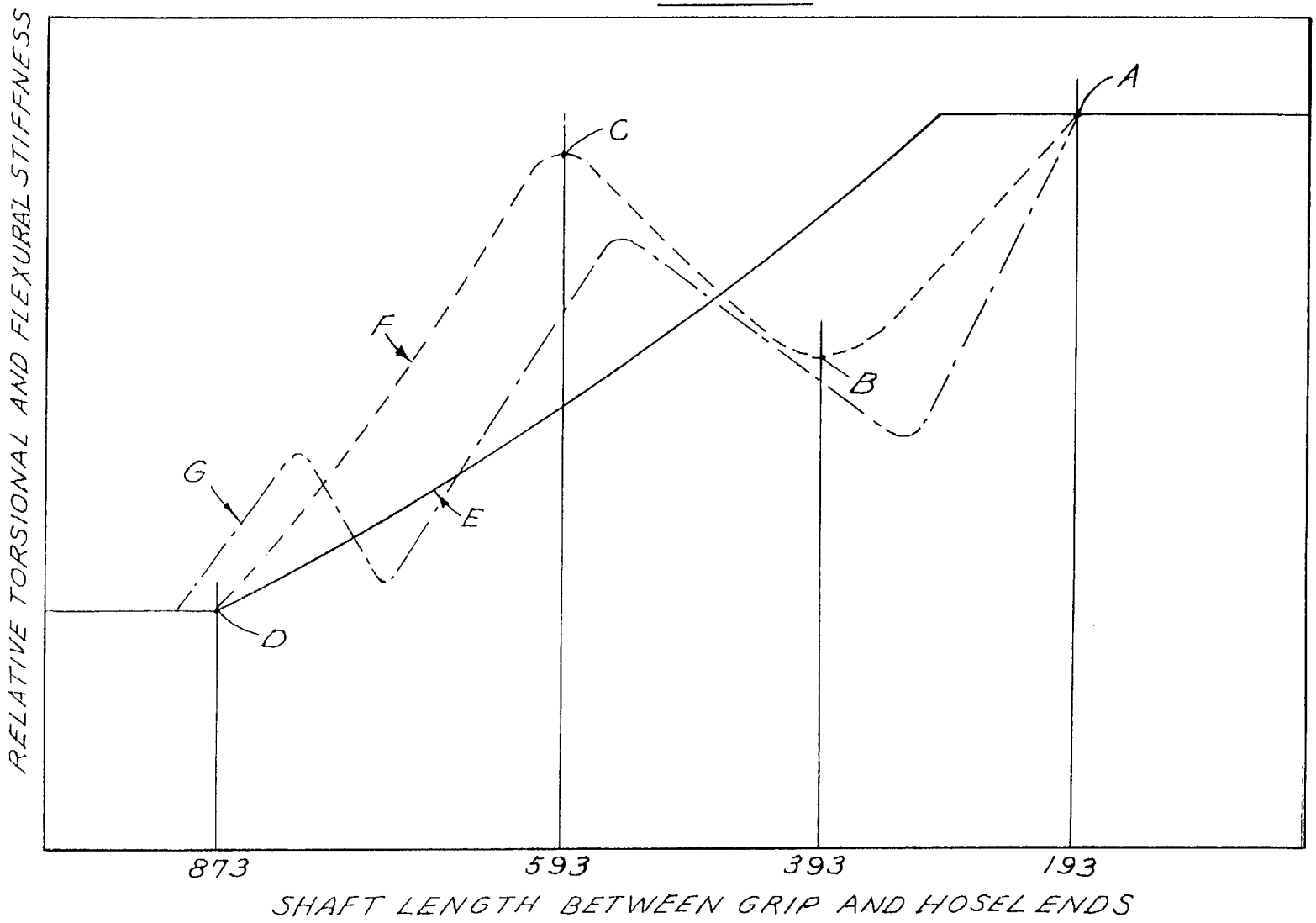
FIG. 4 is a chart showing the relative flex and torsional resistance of three golf club shafts at varying points along their length from the club head end to the grip end.

Referring now to the chart of FIG. 4, comparative flex and torsional resistance points are shown for each of the following types of golf club shafts:

Line E represents a traditional single-tapered shaft;

Line F represents the three frustoconical sectioned shaft of FIGS. 1 and 2; and Line G represents a shaft having five frustoconical sections.

The shafts of lines F and G can be looked upon as "multiple lever systems", which, through centrifugal force, produce greater acceleration, and a more efficient transfer of the golfer's energy from the hands to the clubhead. This is achieved without added material, which results in excess weight. The greater clubhead momentum provided by such shafts gives inherently greater resistance to twisting during the swing.

Figure 5:
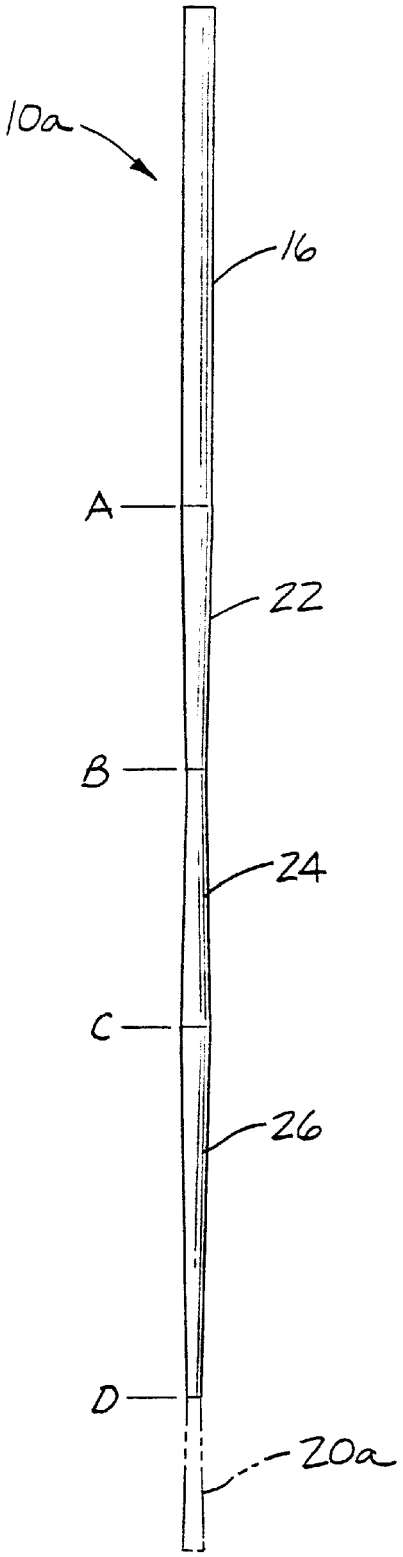
FIGS. 5 and 6 are side elevational views of alternate embodiments of the invention.

Referring now to FIG. 5, the golf club 10*a* is similar to FIG. 2, except that a bottom hosel end section 20*a* is a diverging substantially frustoconical section on which the club head 18 is mounted.

Figure 6:
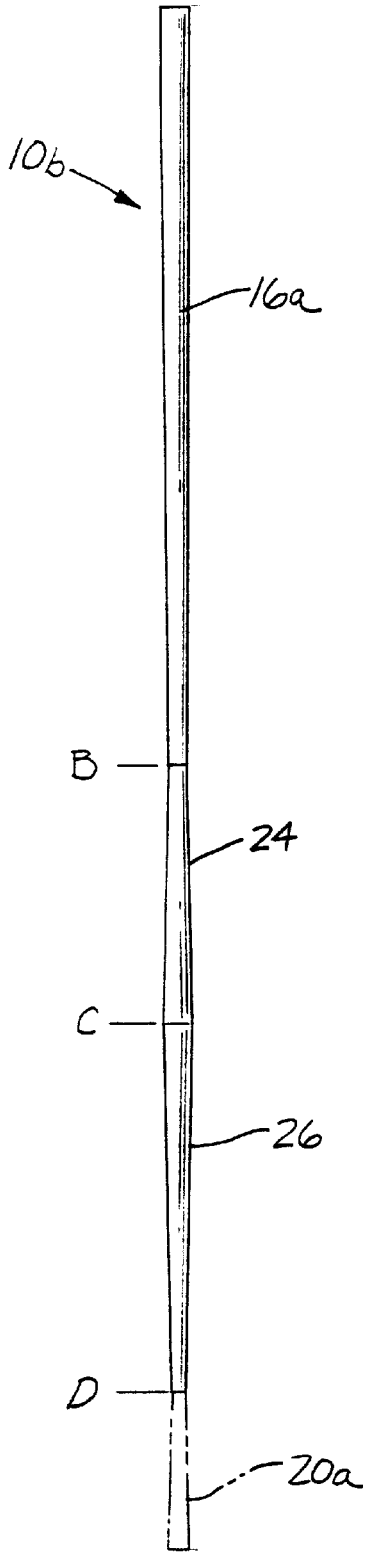

Referring to FIG. 6, a golf club 10*b* is similar to FIG. 5, except that a section 16*a* is a converging substantially frustoconical section, replacing sections 16 and 22.

INDUSTRIAL APPLICABILITY

It should be apparent that by incorporating a variety of composite materials, even in various portions of the shaft, and varying the respective lengths, wall thicknesses, and end diameter dimensions of a plurality of sections, an unprecedented variety of torsional resistance, flexural, and weight distribution profiles are available, adapted to suit the preferences of a wider variety of golfers in providing lightweight shafts with improved performance in conjunction with various clubheads and grips, without requiring added material and consequent excess weight.

More specifically, increased and decreased cross-sections (internal diameter) allow for fine-tuned flexibility and torsional resistance over the full length of the shaft. For example, variable "flex points" can be built into the shaft, which enables different launching angles without changing other factors, such as club head loft, length, etc.

Multiple tapers create multiple flex and torsional resistance points. "Hinging action" creates greater club head speed. Flexing takes place over a larger portion of the shaft, bringing more of the shaft into play, while spreading any stresses more evenly along the shaft to provide greater durability than conventional shafts with a single internal taper.

Using multiple substantially frustoconical outer and inner shapes provides multiple flex points without requiring excess weight, and serves to result in a pleasing, powerful sound in use, while producing a comfortable feel and feedback to the golfer, in the form of a perceptible feeling of the shaft "loading" and "unloading" or "kicking".

While but three general embodiments of the invention have been shown and described, other modifications thereof in the number of frustoconical sections and their respective end diameters, lengths, and wall thicknesses are possible within the scope of the following claims.

What is claimed is:

1. A hollow composite golf club shaft having a grip section at one end thereof and a hosel section with a club head mounted thereon at the other end thereof, said golf club shaft having a substantially circular cross-sectional profile over substantially its entire length between the grip section and the hosel section and characterized by a first section extending between the grip section and a first intermediate location, the internal diameter of said first section diminishing progressively along substantially its entire length from its juncture with the grip section to said first intermediate location, a second section connected to said first section and extending from said first intermediate location to a second intermediate location and having a length approximately equal to that of said first section, the internal diameter of said second section increasing progressively along substantially its entire length from said first intermediate location toward said hosel section, and a third section extending between said second section and said hosel section, the internal diameter of said third section diminishing progressively from said second intermediate location to its juncture with said hosel section.

2. The golf club shaft of claim 1 wherein said internal diameter at the juncture of said first section and said grip section is approximately equal to said internal diameter at said second intermediate location.

3. The golf club shaft of claim 2 wherein said internal diameter at said first intermediate location is greater than said internal diameter at the juncture between said third section and said hosel section.

4. The golf club shaft of claim 1 wherein said third section is longer than either of said first section or said second section.

5. The golf club shaft of claim 4 wherein the length of said third section is shorter than the combined length of said first and second sections.

6. The golf club shaft of claim 1 wherein said grip section is substantially cylindrical in shape.

7. The golf club shaft of claim 1 wherein said grip section is substantially frusto-conical in shape.

8. A hollow composite golf club shaft having a grip section at one end thereof and a hosel section with a club head mounted thereon at the other end thereof, and being characterized by a first intermediary section proximate to said grip section and having an internal diameter that progressively decreases along substantially its entire length from said one end toward said other ends, a second intermediary section connected to said first intermediary section and having an internal diameter that progressively increases along substantially its entire length from said connection with said first intermediary section toward said other end, the length of said first intermediary section being approximately equal to the length of said second intermediary section, and a third intermediary section connected to said second intermediary section and having an internal diameter that progressively decreases along substantially its entire length from said connection with said second intermediary section toward said other end.

9. The golf club shaft of claim 8 wherein said first intermediary section is connected to said grip section.

10. The golf club shaft of claim 9 wherein said third intermediary section is connected to said hosel section.

11. The golf club shaft of claim 10 wherein the third intermediary section is longer than either of said first or second intermediary sections.

12. The golf club shaft of claim 11 wherein the length of the third intermediary section is shorter than the combined length of said first and second intermediary sections.

* * * * *